United States Patent [19]

Kempkes

[11] Patent Number: 4,951,821

[45] Date of Patent: Aug. 28, 1990

[54] PACKING CORNERS FOR PHOTOGRAPHS

[76] Inventor: Duane E. Kempkes, 10026 Kings Plz., Omaha, Nebr. 68122

[21] Appl. No.: 423,003

[22] Filed: Oct. 18, 1989

[51] Int. Cl.[5] ..... B65D 85/48

[52] U.S. Cl. ..... 206/453; 206/586

[58] Field of Search ..... 206/453, 586

[56] References Cited

U.S. PATENT DOCUMENTS

| | | | |
|---|---|---|---|
| 2,226,601 | 12/1940 | Euller | 206/453 |
| 3,047,142 | 7/1962 | Heffley | 206/453 |
| 3,446,345 | 5/1969 | Frosoy | 206/453 |
| 3,843,038 | 10/1974 | Sax | 206/586 |
| 4,063,702 | 12/1977 | Wilde et al. | 206/453 |
| 4,072,231 | 2/1978 | Helms | 206/453 |
| 4,134,496 | 1/1979 | Smith | 206/453 |
| 4,598,825 | 7/1986 | Wiley et al. | 206/453 |

FOREIGN PATENT DOCUMENTS

| | | | |
|---|---|---|---|
| 3701293 | 4/1988 | Fed. Rep. of Germany | 206/586 |

*Primary Examiner*—William I. Price

*Attorney, Agent, or Firm*—Zarley, McKee, Thomte, Voorhees & Sease

[57] ABSTRACT

The packing corner of the present invention includes a resilient exterior frame member formed from first and second generally J-shaped leg members, each leg member having a back portion, a bottom portion and a leg portion. The back portions of the J-shaped leg members are connected at their free ends such that the leg portions are adjacent and spaced apart and oriented to abut the edges of a corner of a photograph. A flange projects from the lower edge of each leg portion for supporting the corner of a photograph thereon. The packing corner has an interior support frame connected to the exterior frame so as to assist in resiliently returning the exterior frame to its original shape after any deformation thereof. The bottom of the packing corner has a pair of walls depending from the back portions of the J-shaped leg members, with a plate secured therebetween in a plane generally parallel to the flanges. A support sheet material is retained by the plate and will support the body of a photograph being retained by the packing corners. A lip portion projects from the upper edge of each leg portion of the J-shaped leg members to retain the corner of the photograph from moving upwardly from beyond the packing corner.

7 Claims, 2 Drawing Sheets

PACKING CORNERS FOR PHOTOGRAPHS

Technical Field

The present invention relates generally to packing materials, and more particularly to improved corners utilized to hold photographs in position within packing materials.

Background of the Invention

Photographs and other art work are commonly packaged for transport, rather than carrying the article unprotected. While it was common to package such materials by rolling them into a cylindrical shape and inserting them within a hollow tube, this method was undesirable because of the condition of the article upon removal from the tube. In many cases, it is difficult to retain the original flat condition of the article.

For those photographs and the like which are desired to be transported in a flat condition, it was common to insert the article between layers of flat cardboard. While this practice eliminated the curling characteristic of mailing tubes, the photograph was still capable of sliding between the cardboard supports, thereby damaging the corners and edges of the photograph.

It is therefore a general object of the present invention to provide packing corners for retaining photographs and the like within packaging materials.

Another object of the present invention is to provide packing corners for photographs or the like which will not damage the corners of the photograph during transport.

A further object of the present invention is to provide packing corners for photographs or the like which will retain the photograph positioned on a piece of support material.

Yet another object is to provide packing corners for photographs or the like which are economical to manufacture, refined in appearance and easy to use.

These and other objects of the present invention will be apparent to those skilled in the art.

Summary of the Invention

The packing corner of the present invention includes a resilient exterior frame member formed from first and second generally J-shaped leg members, each leg member having a back portion, a bottom portion and a leg portion. The back portions of the J-shaped leg members are connected at their free ends such that the leg portions are adjacent and spaced apart and oriented to abut the edges of a corner of a photograph. A flange projects from the lower edge of each leg portion for supporting the corner of a photograph thereon. The packing corner has an interior support frame connected to the exterior frame so as to assist in resiliently returning the exterior frame to its original shape after any deformation thereof. The bottom of the packing corner has a pair of walls depending from the back portions of the J-shaped leg members, with a plate secured therebetween in a plane generally parallel to the flanges. A support sheet material is retained by the plate and will support the body of a photograph being retained by the packing corners. A lip portion projects from the upper edge of each leg portion of the J-shaped leg members to retain the corner of the photograph from moving upwardly from beyond the packing corner.

Description of the Preferred Embodiment

Figure 1:
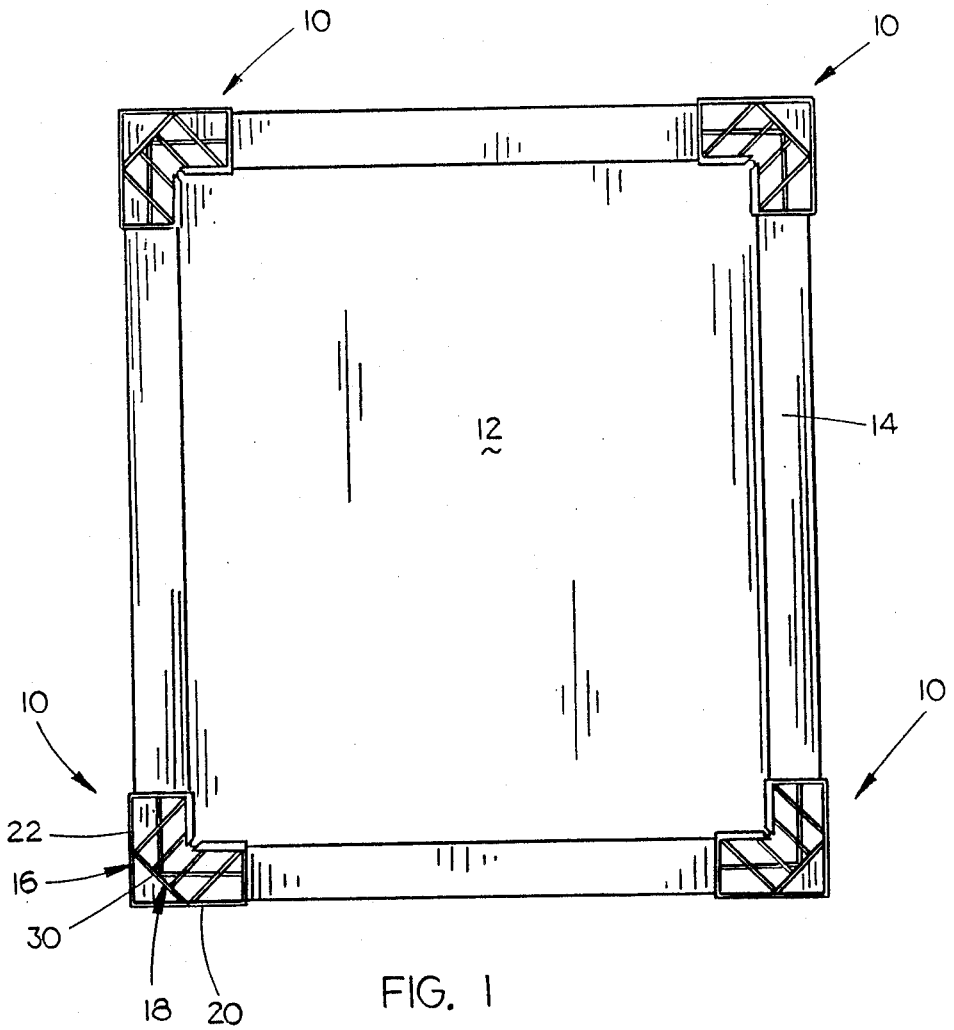
FIG. 1 is a top plan view of a photograph held in position on a support material by four packing corners of the present invention.

Referring now to the drawings, in which similar or corresponding parts are identified with the same reference numeral, and more particularly to FIG. 1, the packing corner of the present invention is identified generally at 10 and is utilized on each corner of a rectangular photograph 12, or the like, to hold the photograph 12 in position on a sheet of support material 14. The entire unit, including sheet material 14, photograph 12 and packing corners 10, may then be wrapped for transport.

Figure 2:
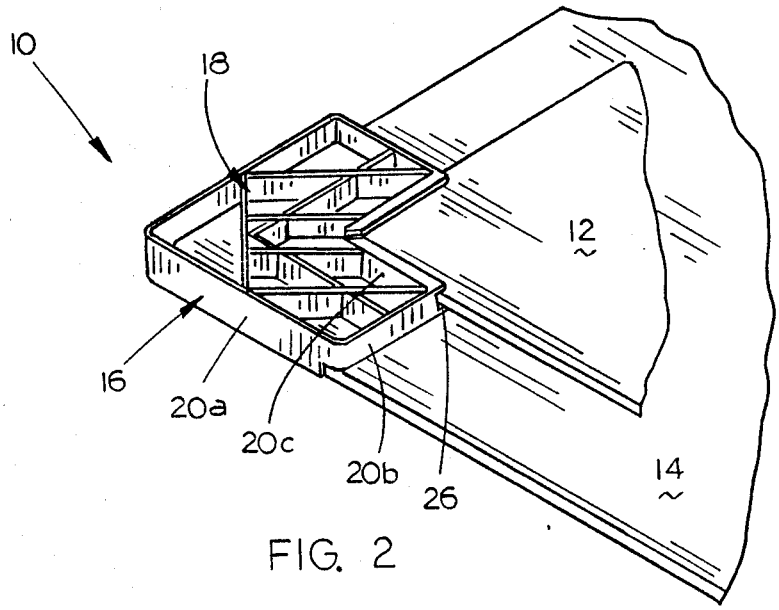
FIG. 2 is an enlarged perspective view of one packing corner of the present invention installed on a sheet of support material and holding the photograph in position.
Figure 3:
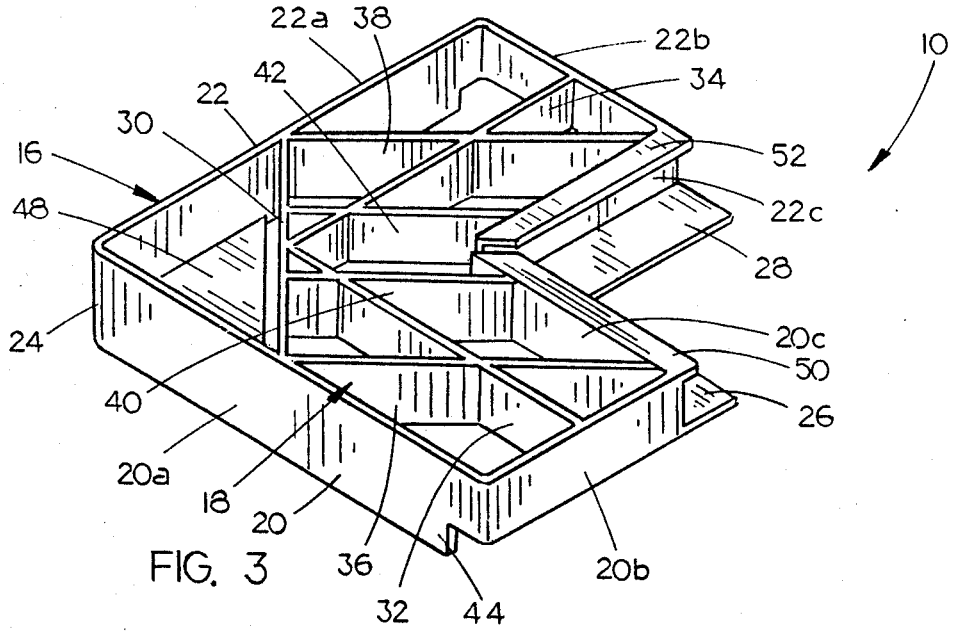
FIG. 3 is an enlarged perspective view of the packing corner of FIG. 2.
Figure 4:
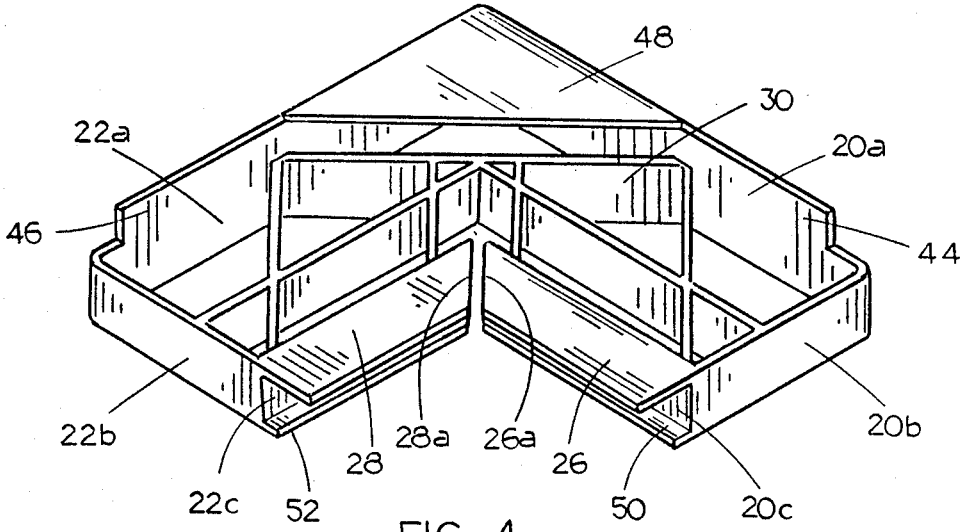
FIG. 4 is an enlarged perspective view of a packing corner in an upside down position, to show the bottom thereof.

Referring now to FIGS. 2–5, packing corner 10 is preferably formed of a resilient plastic material, and includes an exterior frame designated generally at 16 and an interior support frame designated generally at 18. Exterior frame 16 includes first and second J-shaped legs 20 and 22, respectively (see FIG. 1). As shown in FIG. 3, each J-shaped leg 20 and 22 includes a back portion 20*a*, 22*a*; bottom portion 20*b*, 22*b* extending perpendicularly from backs 20*a* and 22*a*; and a leg portion 20*c*, 22*c* extending parallel to backs 20*a* and 22*a*. Backs 20*a* and 22*a* are connected at their free ends to form a perpendicular corner 24, with legs 20*c* and 22*c* oriented generally perpendicular to one another and with their free ends closely adjacent, but spaced apart (see FIG. 4).

Figure 5:
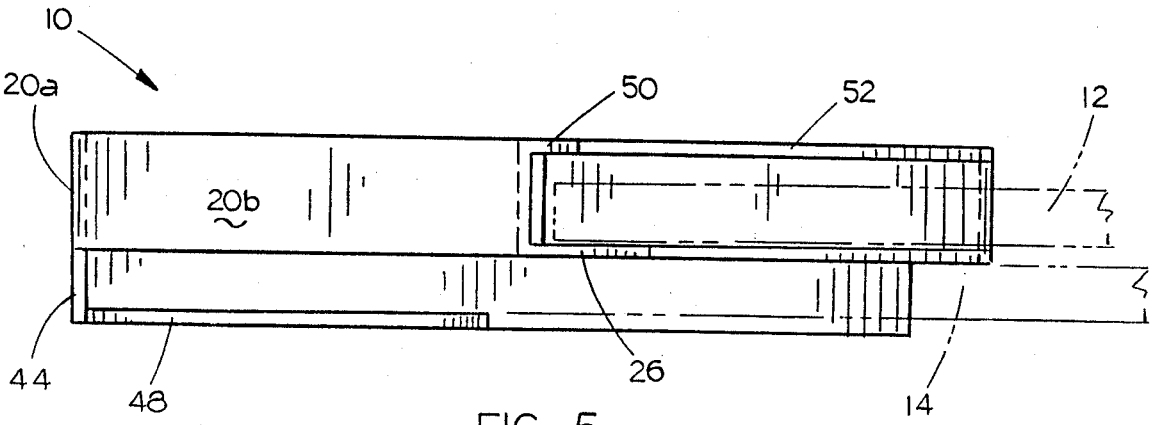
FIG. 5 is an elevational view taken from the right lower side of FIG. 3 showing a support sheet and photograph connected thereto in broken lines.

A flange 26 extends horizontally from the lower edge of leg 20*c*, and will receive and support a portion of photograph 12, as seen in FIGS. 2 and 5. A similar flange 28 extends horizontally from the lower edge of leg 22*c*. Flanges 26 and 28 have a diagonal edge 26*a* and 28*a* respectively formed parallel to one another at an approximate 45-degree angle. In this way, J-shaped legs 20 and 22 are maintained separate from one another without overlapping of flanges 26 and 28.

Interior support frame 18 includes a cross member 30 extending between backs 20*a* and 22*a* of J-shaped legs 20 and 22. Cross member 30 is affixed between backs 20*a* and 22*a* so as to form an equilateral triangle with corner 24 the apex thereof. Movement of a photograph on top of flanges 26 and 28 will be transmitted along J-shaped legs 20 and 22 and thence to cross member 30, rather than to corner 24. The space between legs 20*c* and 22*c* of J-shaped legs 20 and 22 allows for some movement of the photograph while preventing bending of the corners or edges of the photograph.

Interior support frame 18 further includes a pair of beams 32 and 34, beam 32 extending between bottom 20*b* and the mid point of cross member 30, parallel to leg 20*c* and back 20*a* of J-shaped leg 20. Beam 34 extends between bottom 22b and the mid point of cross member 30, parallel to leg 22c and back 22a of J-shaped leg 22. A pair of diagonal beams 36 and 38 extend from the intersection of cross member 30 with backs 20a and 22a, respectively, to the juncture of bottom 20b with leg 20c and the juncture of bottom 22b with leg 22c, respectively, as shown in FIG. 3. A short diagonal member 40 extends from the free end of leg 20c to cross member 30 parallel to diagonal beam 36, and a similar short diagonal 42 extends from the free end of leg 22c to an intermediate portion of cross member 30 parallel to diagonal beam 38. Beams and diagonals 32–42 are all installed to assist in maintaining the structural integrity of packing corner 10 to retain a photograph 12 in position without bending the edges or corner. Furthermore, the orientation of diagonals 36–42 will permit resilient compression between the leg and back portions of each J-shaped leg--thereby, further protecting the photograph.

A wall 44 depends from the lower edge of back 20a of J-shaped member 20 and coplanar with back 20a. A similar wall 46 depends coplanar with back 2a of J-shaped leg 22. A triangular-shaped plate 48 extends between the lower edges of walls 44 and 46, and extends horizontally parallel to flanges 26 and 28. Plate 48 preferably extends from corner 24 to a location approximately under cross member 30. As shown in FIGS. 2 and 5, plate 48 will receive and hold a sheet of support material 14 in position with respect to packing corner 10.

A lip 50 is formed along the upper edge of leg 20c of J-shaped leg 20, and projects horizontally to retain the photograph 12 from moving upwardly beyond the packing corner so as to be dislodged from the four packing corners 10. A similar lip 52 is formed on leg 22c of J-shaped leg 22.

In use, the photograph 12, or the art work to be packaged, is measured. A sheet of support material 14 is then provided which has dimensions equal to the length and width of the photograph plus the width of two legs of the packing corners 10. Each packing corner is then positioned on the four corners of sheet material 14 with the corner of the sheet material supported on plate 48, and with the packing corners 10 oriented in the appropriate position by depending walls 44 and 46. The photograph 12 may then be inserted and supported on flanges 26 and 28 of each of the four packing corners 10. Sheet material 14 is in contact with depending walls 44 and 46, so as to prevent the inadvertent forcing of packing corners inwardly to bend photograph 12. The corners of photograph 12, will be received between the free ends of legs 20c and 22c, so as to maintain a sharp crisp corner. The entire unit may then be wrapped with the appropriate paper or the like, with confidence that the photograph packaged therein will not be bent or damaged during transport.

Whereas the invention has shown and described in connection with the preferred embodiments thereof, it will be understood that many modifications, substitutions and additions may be made which are within the intended broad scope of the appended claims. For example, if the exterior frame 16 were formed of an easily compressible or flexible material, such as foam rubber, legs 20c and 22c could be connected and yet maintain the compressibility of the J-shaped legs 20 and 22. Thus, there has been shown and described an improved packing corner which accomplishes at least all of the above stated objects.

I claim:

1. A packing corner for retaining photographs and the like on a support sheet, comprising:

a resilient exterior frame member formed from first and second generally J-shaped leg members;

each said J-shaped leg member including a back portion having first and second ends, a bottom portion extending from the first end of the back portion, and a leg portion extending from the bottom portion;

said back portions of said J-shaped legs being connected together at their second ends such that said leg portions are oriented at an angle to abut the edges of a photograph corner.

2. The packing corner of claim 1, further comprising:

first flange means projecting from the lower edge of said leg portion of said first J-shaped leg member, for supporting an edge of a photograph against said leg portion; and

3. The packing corner of claim 2, further comprising:

a first lip portion projecting from the upper edge of said leg portion of said first J-shaped leg member, generally parallel to said first flange; and a second lip portion projecting from the upper edge of said leg portion of said second J-shaped leg member, generally parallel to said second flange.

4. A packing corner for retaining photographs and the like on a support sheet, comprising:

a resilient exterior frame member formed from first and second generally J-shaped leg members;

each said J-shaped leg member including a back portion, a bottom portion extending from one end of the back portion, and a leg portion extending from the bottom portion;

the ends of said leg portions which project from said bottom portions being adjacent one another, but spaced apart, such that each said J-shaped leg member is independently resiliently compressible; and said back portions of said J-shaped legs being connected such that said leg portions are oriented at an angle to abut the edges adjacent a photograph corner.

5. A packing corner for retaining photographs and the like on a support sheet, comprising:

a resilient exterior frame member formed from first and second generally J-shaped leg members;

each said J-shaped leg member including a back portion, a bottom portion extending from one end of the back portion, and a leg portion extending from the bottom portion;

said back portions of said J-shaped legs being connected such that said leg portions are oriented at an angle to abut the edges adjacent a photograph corner; and an interior support frame mounted within said exterior frame member, designed to assist in resiliently returning the exterior frame to its original shape after any deformation thereof.

6. The packing corner of claim 5, wherein said interior support frame includes a cross member affixed between the back portions of said first and second J-shaped leg members.

7. The packing corner for retaining photographs and the like on a support sheet, comprising:

a resilient exterior frame member formed from first and second generally J-shaped leg members;

each said J-shaped leg member including a back portion, a bottom portion extending from one end of the back portion, and a leg portion extending from the bottom portion;

said back portions of said J-shaped legs being connected such that said leg portions are oriented at an angle to abut the edges adjacent a photograph corner;

means for selectively retaining a portion of a support member, mounted on said exterior frame, comprising:

a first wall depending from said first J-shaped leg member back portion;

a second wall depending from said second J-shaped leg member back portion; and a plate secured between said first and second walls for supporting a portion of a support member below said exterior frame member.

* * * * *